US011306889B1

(12) United States Patent
Wesley et al.

(10) Patent No.: US 11,306,889 B1
(45) Date of Patent: Apr. 19, 2022

(54) LIGHTING ASSEMBLY

(71) Applicants: Renetta LaTrece Wesley, Cedar Hill, TX (US); Dante Wesley, Cedar Hill, TX (US)

(72) Inventors: Renetta LaTrece Wesley, Cedar Hill, TX (US); Dante Wesley, Cedar Hill, TX (US)

( * ) Notice: Subject to any disclaimer, the term of this patent is extended or adjusted under 35 U.S.C. 154(b) by 0 days.

(21) Appl. No.: 17/003,763

(22) Filed: Aug. 26, 2020

Related U.S. Application Data

(60) Provisional application No. 62/963,358, filed on Jan. 20, 2020.

(51) Int. Cl.

| | |
|---|---|
| ***F21S 10/06*** | (2006.01) |
| ***G08B 5/38*** | (2006.01) |
| ***F21S 9/02*** | (2006.01) |
| ***F21V 23/04*** | (2006.01) |
| ***G08C 17/02*** | (2006.01) |
| ***F21V 23/06*** | (2006.01) |

(52) U.S. Cl.
CPC ..... *F21S 10/06* (2013.01); *F21S 9/022* (2013.01); *F21V 23/0435* (2013.01); *G08B 5/38* (2013.01); *G08C 17/02* (2013.01); *F21V 23/06* (2013.01)

(58) Field of Classification Search
CPC ..... F21S 10/06–066; F21S 23/0407; F21S 23/0435; F21S 9/022–024; G08B 5/38; F21V 23/0407; F21V 23/0435
See application file for complete search history.

(56) References Cited

U.S. PATENT DOCUMENTS

2012/0120649 A1* 5/2012 Catalano ..... F21K 9/61 362/231
2018/0259171 A1* 9/2018 Pharr ..... F21V 23/0435
2020/0149709 A1* 5/2020 Demmelhuber ..... H05B 47/18
2021/0097846 A1* 4/2021 Rich ..... G08B 5/38

FOREIGN PATENT DOCUMENTS

WO WO-2007133868 A2 * 11/2007 ..... B64F 1/20

* cited by examiner

*Primary Examiner* — Mariceli Santiago
(74) *Attorney, Agent, or Firm* — Kirby Drake

(57) ABSTRACT

A lighting assembly is configured to create an emergency notification. The lighting assembly has a housing with a housing first surface and a housing second surface. A plurality of strobe lights is arranged into at least one row and at least four columns. A direct current power system is joined to the plurality of strobe lights and further comprising a printed circuit board electrically coupled to radio frequency relay switch, and a battery. A wireless remote is communicatively coupled to the radio frequency relay switch. Activating the wireless remote directs the printed circuit board to provide power to the plurality of strobe lights creating the emergency notification.

5 Claims, 4 Drawing Sheets

LIGHTING ASSEMBLY

RELATED APPLICATION

This application claims priority to provisional patent application U.S. Ser. No. 62/963,358 filed on Jan. 20, 2020, the entire contents of which is herein incorporated by reference.

BACKGROUND

The embodiments herein relate generally to emergency notification systems.

Prior to embodiments of the disclosed invention, it was difficult to locate an emergency. This caused a person in emergency to suffer while assistance was delayed. Embodiments of the disclosed invention solve this problem.

SUMMARY

A lighting assembly is configured to create an emergency notification. The lighting assembly has a housing with a housing first surface and a housing second surface. A plurality of strobe lights is arranged at least one row and at least four columns. A direct current power system is joined to the plurality of strobe lights and further comprising a printed circuit board electrically coupled to radio frequency relay switch, and a battery. A wireless remote is communicatively coupled to the radio frequency relay switch. Activating the wireless remote directs the printed circuit board to provide power to the plurality of strobe lights creating the emergency notification.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
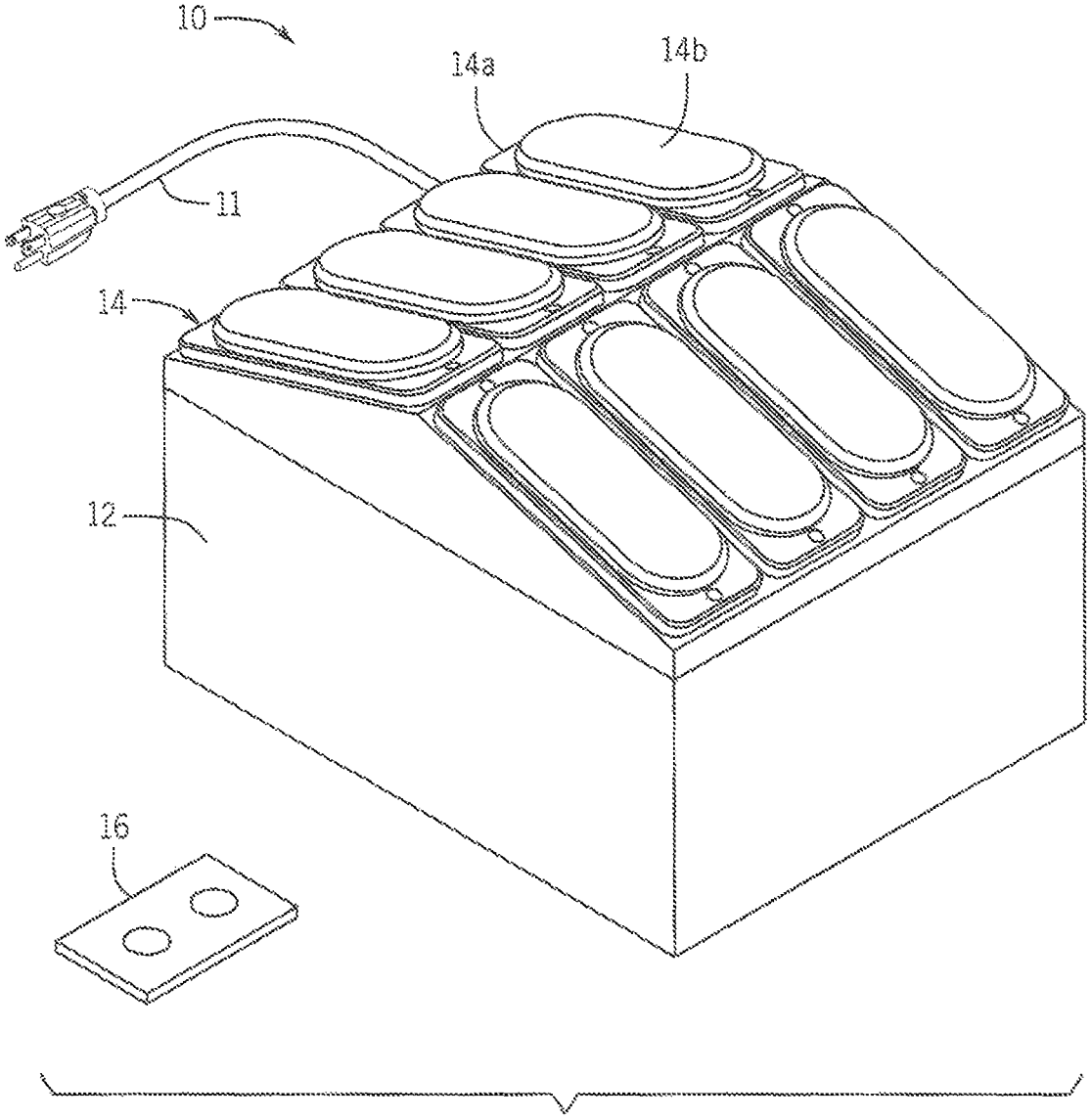
FIG. 1 shows a perspective view of one embodiment of the present invention.

By way of example, and referring to FIG. 1, one embodiment of a lighting system 10 further comprises a housing 12 joined to a power supply 11. The housing 12 is joined to a lighting assembly 14.

Figure 2:
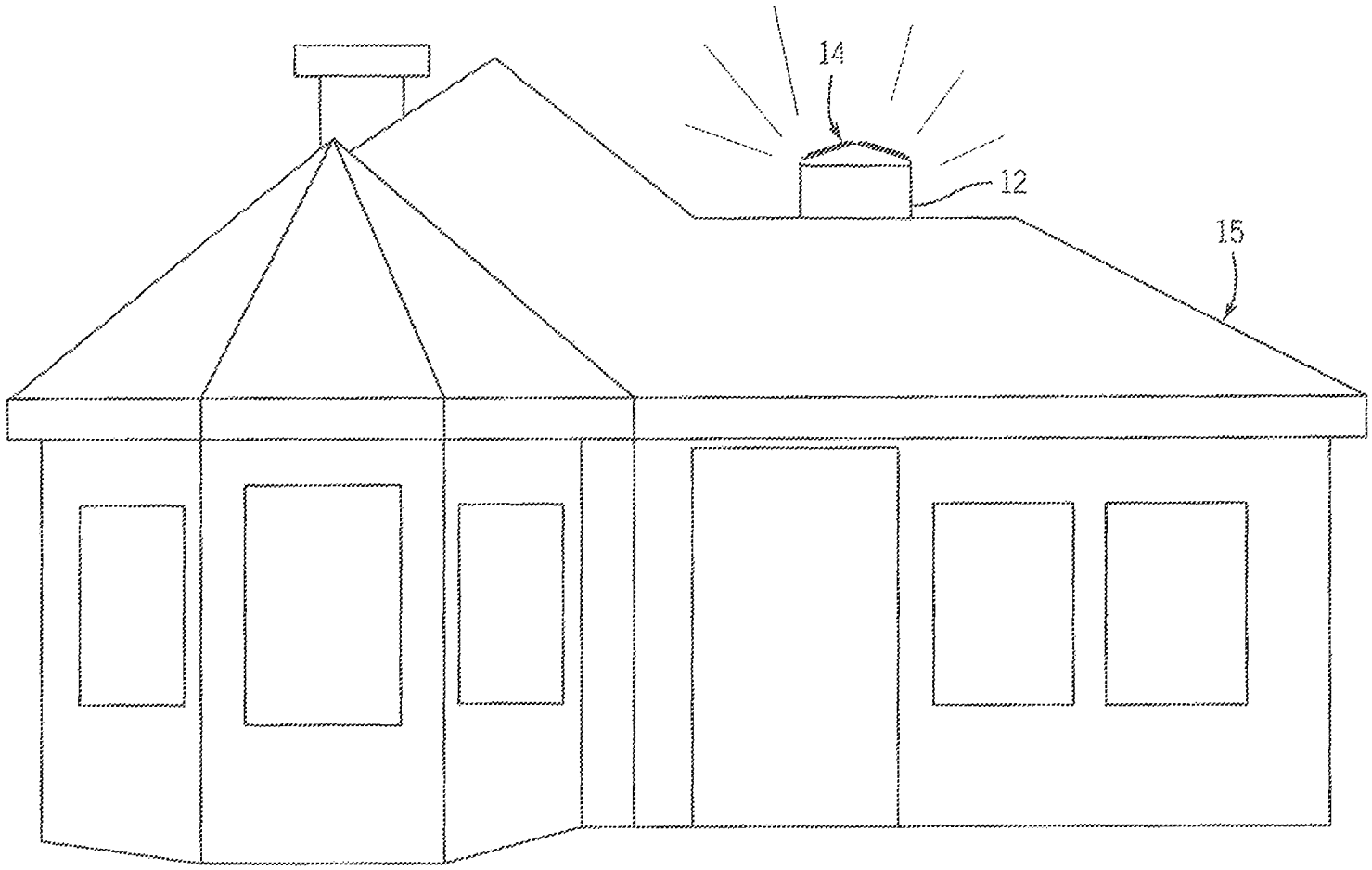
FIG. 2 shows a perspective view of one embodiment of the present invention shown in use.
Figure 3:
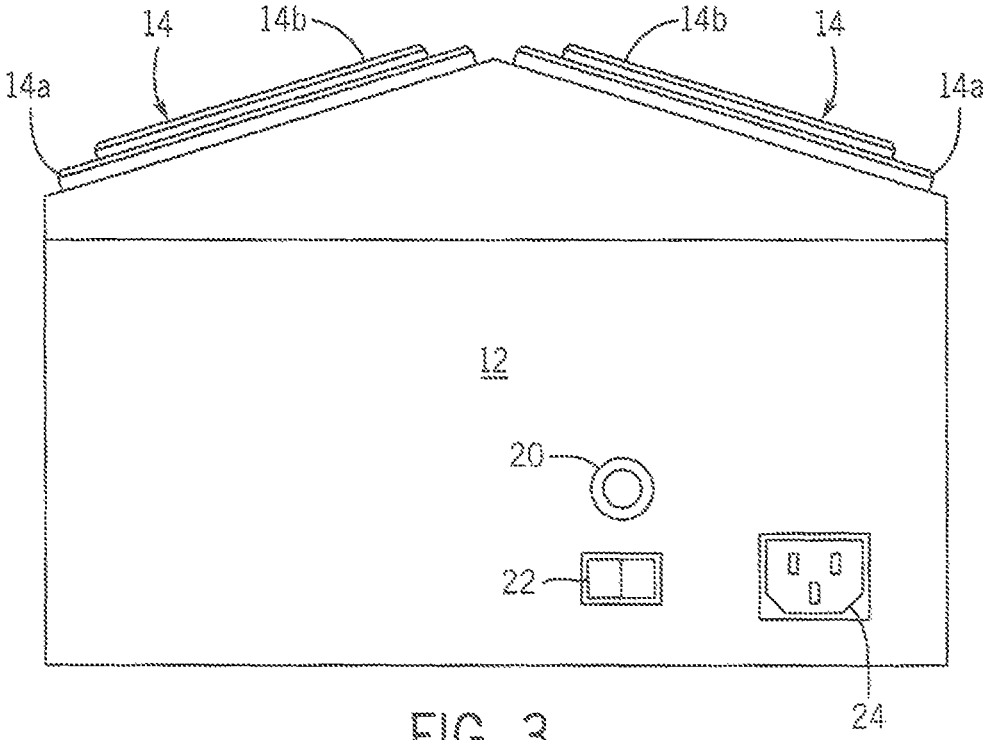
FIG. 3 shows a side elevation view of one embodiment of the present invention.

The lighting assembly 14 further comprises a plurality of strobe lights 14*a*. Each strobe light 14*a* is covered by a lens 14*b*. FIG. 1 illustrates a bank of eight strobe lights 14*a* arranged into two rows and four columns. The columns are approximately parallel but the rows are not, meeting at an angle somewhat like a roof on top of the housing 12. The pitched upper surface is critical in order to prevent dirt or precipitation from collecting on the plurality of strobe lights 14*a*. This can be shown in FIG. 2 where the housing 10 is installed onto a roof 15.

A first side of housing 12 further comprises a strobe mode selector 20, an on/off switch 22, and a power receptable 24. The power receptacle is electrically coupled to the power supply 11.

Figure 4:
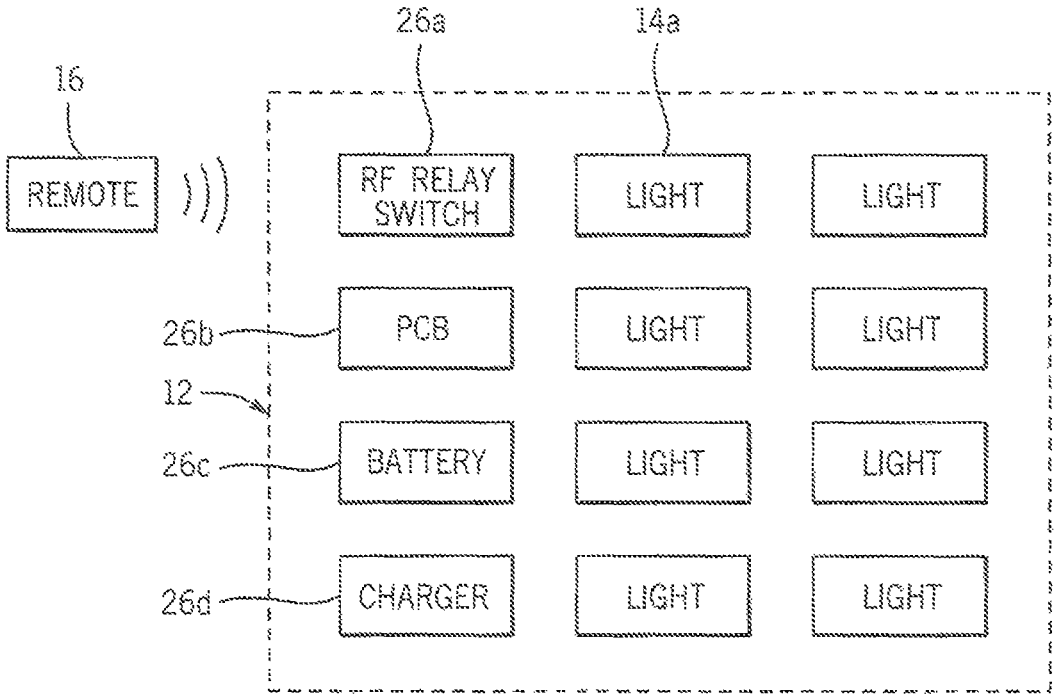
FIG. 4 shows a block diagram of one embodiment of the present invention.

The lighting system 10 further comprises a direct current power system shown in FIG. 4. A radio frequency relay switch 26*a* is electrically coupled to a printed circuit board 26*b*. The printed circuit board 26*b* is electrically coupled to a battery 26*c* and the plurality of strobe lights 14*a*. A charger 26*d* is electrically coupled to the battery 26*c* and the power receptable 24. The printed circuit board 26*b* is electrically coupled to the strobe mode selector 20 and the on/off switch 22.

To use the device, a user can engage the wireless remote 16 to send a signal to the radio frequency relay switch 26*a*. The radio frequency relay switch 26*a* engages the printed circuit board 26*b* to direct power from the battery 26*c* to the plurality of strobe lights 14*a*. This activates the plurality of strobe lights 14*a* in a strobe light pattern.

Figure 5:
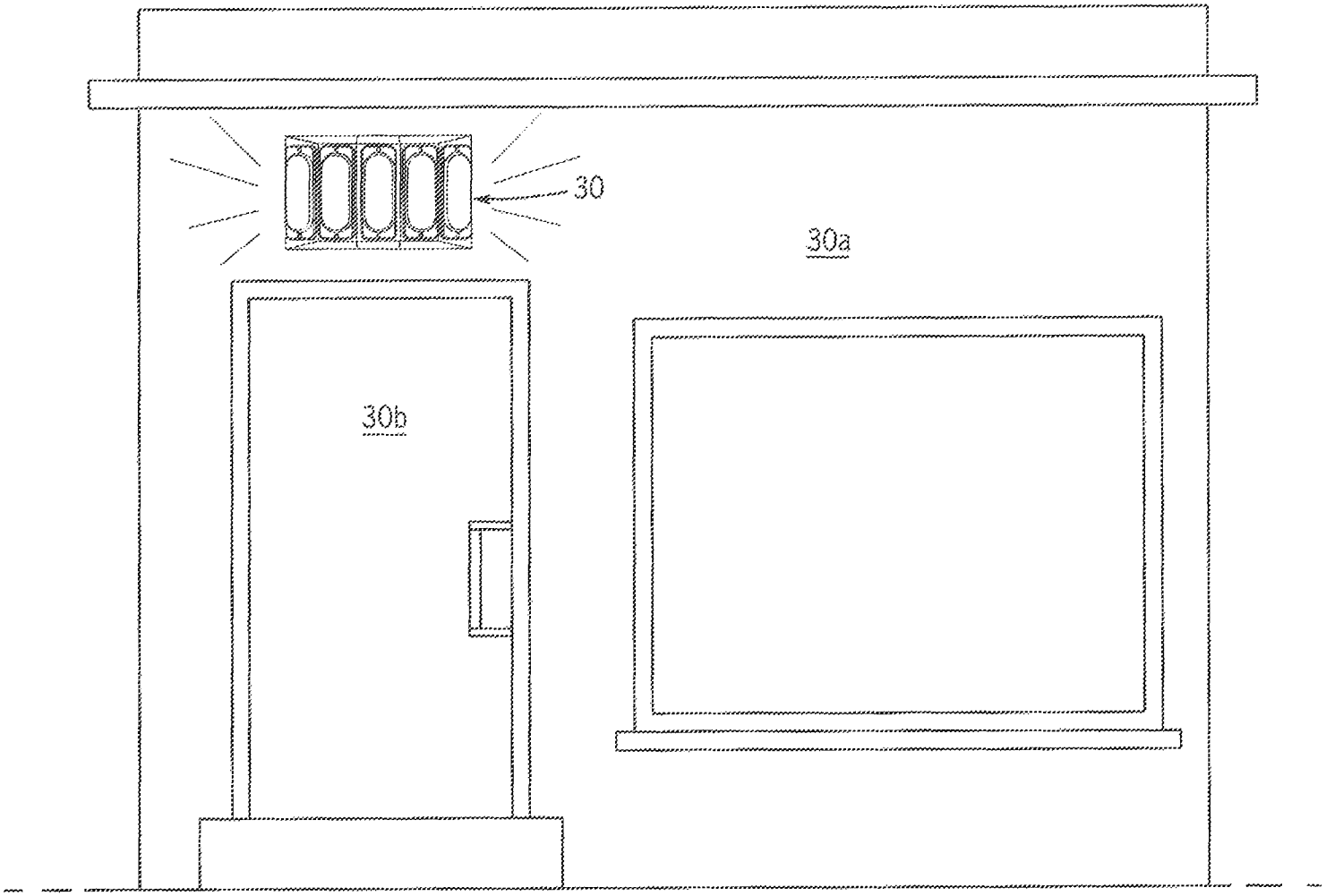
FIG. 5 shows a perspective view of one embodiment of the present invention shown in use.

Turning to FIG. 5, a housing 30 is installed onto a wall 30*a* above a door 30*b*. The housing 30 has one row with five columns of strobe lights as opposed to housing 10 which has more rows and fewer columns.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A lighting assembly, configured to create an emergency notification, the lighting assembly comprising:

a housing having a housing first surface and a housing second surface;

a plurality of strobe lights arranged into at least two rows and at least four columns, wherein the at least four columns are approximately parallel and the at least two rows meet at an angle;

a direct current power system joined to the plurality of strobe lights and further comprising a printed circuit board electrically coupled to a radio frequency relay switch and to a battery; and a wireless remote communicatively coupled to the radio frequency relay switch to send a signal to the radio frequency relay switch which engages the printed circuit board to direct power from the battery to the plurality of strobe lights creating the emergency notification.

2. The lighting assembly of claim 1, further comprising a curved lens, arranged over each of the plurality of strobe lights.

3. The lighting assembly of claim 2, further comprising a strobe mode selector, an on/off switch, and a power receptacle, each of the strobe mode selector, the on/off switch, and the power receptacle positioned on the housing first surface, mechanically coupled to the housing, and electrically coupled to the printed circuit board.

4. The lighting assembly of claim 3 further comprising:

a charger electrically coupled to the battery and the power receptacle.

5. The lighting assembly of claim 1 wherein the lighting assembly is installed on a roof.

* * * * *